US006124836A

United States Patent [19]

Rogers

[11] Patent Number: 6,124,836

[45] Date of Patent: Sep. 26, 2000

[54] RV MOUNTING FOR A SATELLITE DISH

[76] Inventor: John Stephen Rogers, #60, 5018 45th Street, Red Deer, Alberta, Canada, T4N 1K9

[21] Appl. No.: 09/290,191

[22] Filed: Apr. 13, 1999

[51] Int. Cl.[7] ..... H01Q 3/02

[52] U.S. Cl. ..... 343/882; 343/713; 343/880; 343/881

[58] Field of Search ..... 343/880, 881, 343/882, 713; H01Q 3/02

[56] References Cited

U.S. PATENT DOCUMENTS

| | | | |
|---|---|---|---|
| 5,554,998 | 9/1996 | Sherwood et al. | 343/881 |
| 5,929,817 | 7/1999 | Clark | 343/882 |
| 5,945,945 | 8/1999 | Wagner et al. | 343/882 |

*Primary Examiner*—Hoanganh Le
*Assistant Examiner*—Hoang Nguyen

[57] ABSTRACT

In a collapsible roof mounting for orienting a satellite dish system from below, an upper channel-shaped formation arranged to present a dish-shaped component adjacent one end and an arm formation for the feed horn intermediately thereof and nestable within and interconnected to a lower channel-shaped formation adjacent the other end for swinging movement thereabove, a tubular shaft formation supporting the lower channel-shaped formation centrally thereof from below for rotation about a substantially upright axis, a displaceable linkage including a worm gear interconnected to the upper channel-shaped formation and a worm extending axially of the tubular shaft formation for swinging the upper channel-shaped formation upwardly from the nested disposition and reversely, a handle formation for the tubular shaft formation below the roof for imparting rotation thereto and a crank for the worm located below the handle formation for imparting displacement to the worm and worm gear.

23 Claims, 8 Drawing Sheets

RV MOUNTING FOR A SATELLITE DISH

FIELD OF THE INVENTION

This invention relates to improvements in satellite dish systems for the reception of signals communicated by satellite and originating from a controlled broadcasting source.

More particularly this invention relates to an improved mounting for the essential components of satellite dish systems for anchoring same either in a particular location or attaching same to the roof of a vehicle such as a van, mobile home or other recreational vehicle commonly denoted as an RV, and for orienting such components for optimum signal reception.

BACKGROUND OF THE INVENTION

Satellite dish systems currently available in the North American markets, especially for use with vehicles such as an RV, are for the most part complex, usually fully automated, utilizing programmed circuitry and motors to rotate, elevate and fix the position of the dish and associated elements in seeking and establishing an optimum position for receiving signals communicated from a selected satellite.

Experience has shown that difficulties have arisen in controlling such automated systems because of the need for properly sequentially implementing the steps required to position the satellite dish and associated elements which steps may vary from manufacturer to manufacturer.

More particularly there is room for error in selecting the requisite switching to energize the motor circuitry and in engaging the locator buttons to fix the position of the dish at any specified time.

Moreover, such automated satellite dish systems are usually limited to the reception of signals from one of the many broadcast satellite sources and cannot be readily modified or altered to accommodate the full range.

Also, many automated satellite systems are costly to manufacture, install and maintain, and for that reason beyond the budget of many families or households who would appreciate having the option to utilize a more simplified, less expensive yet fully operational satellite dish system for their office, dwelling, home or RV use.

OBJECTS OF THE INVENTION

Accordingly, one important object of this invention is to provide a more simplified support structure for the ready mounting of a suitable satellite dish and associated elements upon the roof of a building or any vehicle, which support structure can be mechanically operated from within the building or vehicle to displace and properly orient same and fix their positions so as to optimize reception of signals from a selected satellite.

Alternatively, it is an object that if a motorized deployment were desirable the support structure would lend itself to the addition of a simplified arrangement of motor(s) and associated circuitry to impart the requisite displacement.

More particularly it is an object of this invention to provide a structurally sound mounting whose minimal components more than adequately support the satellite dish and associated elements in the inoperative and operative dispositions which components can be readily displaced and fixed in position through execution of but a few steps so as to reduce if not eliminate error and frustration in establishing the optimum setting for the reception of signals from a selected satellite.

It is also an important object of this invention to provide a mounting that can be securely anchored against dislodgement in either the optimum signal receiving disposition or when collapsed into a compact arrangement when not in use, such as when subjected to high velocity winds or during travel of a vehicle.

Still another object of the invention is to provide a mounting that can readily accommodate the horn or the LNB (low noise barrier) of alternative signal source systems for reception from alternative selected transmitting satellites so that a wide range of programming is available with minimum adjustment.

Another very important object is to provide a satellite dish system of the character described which, as compared with known systems is much less costly to manufacture, assemble, install and maintain, yet fully reliable over a wide range of operating conditions either as a stationary mounting upon a building or dwelling or when attached for transport upon the roof of a vehicle.

FEATURES OF THE INVENTION

One feature of the invention resides in providing a mounting in which the support for the respective dish-shaped component and the associated feed horn component or the like includes a first or upper channel-shaped formation arranged so that the spaced-apart side wall portions thereof upstand from a bottom wall portion thereof, with the side wall portions configured for attachment of the dish-shaped component on one end and for pivotal attachment therebetween of the arm or column for the feed horn or LNB component towards the other end.

Thus with such channel shaped support can loading applied thereto be more uniformly distributed and balanced so as to extend the operational life of the system.

Another feature of the invention resides in providing a support for the first or upper channel-shaped formation in the form of a second or lower channel-shaped formation so arranged and configured that the upper channel-shaped formation nests within the lower channel-shaped formation in the collapsed generally horizontal disposition and so pivotally connected between the upstanding side wall portions thereof as to swing upwardly from the collapsed disposition to an inclined disposition in relation thereto and reversely. With this arrangement can the requisite loading to be applied by the upper channel-shaped formation to the lower channel-shaped formation also be effectively distributed and balanced in conjunction with the remaining structure for imparting displacement thereto and so extend operational life.

Still another feature of the invention resides in providing a support for the nestable upper and lower channel-shaped formations centrally thereof in the form of a tubular shaft formation attached to and extending below the bottom wall portion of the lower channel-shaped formation at substantially right angles thereto and offset from the pivotal attachment between upper and lower channel-shaped formations, with the tubular shaft formation supported for rotation upon a suitable bearing structure anchored therebelow and with the central passage of the tubular shaft at the upper end opening through the bottom wall portion of the lower channel-shaped formation to accommodate the centrally axially aligned instrumentation for imparting, from below, swinging movement to the upper channel-shaped formation about the pivotal connection to the lower channel-shaped formation.

Still more particularly another feature of the invention resides in providing a swingable linkage extending between the side walls of the upper channel-shaped formation in a position correspondingly offset from its pivotal connection to the side walls of the lower channel-shaped formation to overlie the open upper end of the tubular shaft which linkage is displaceable by the centrally axially aligned instrumentation either upwardly in one direction to elevate the upper channel-shaped formation from the aforementioned nested disposition to the inclined disposition or downwardly in the other direction to lower same into the nested disposition.

Another feature resides in providing such axially aligned instrumentation in the form of an externally threaded post or worm mounted for rotation centrally within and extending axially through the tubular shaft to engage with a worm gear presented by the linkage overlying the open upper end of the tubular shaft, whereby under rotation imparted to the worm and translated to the worm gear of the linkage the upper channel-shaped formation is displaced from its nested disposition to its aligned disposition and reversely depending upon the direction of rotation imparted to the worm.

Still another feature resides in providing a centrally apertured anchor plate which aperture is defined by an integral sleeve or collar which registers within an established opening through the roof communicating with the interior for supporting the assembly of nestable channel-shaped formations upon a roof top or upon the roof of a vehicle such as an RV. The upper end of the integral sleeve or collar is provided with a suitable bushing telescoped thereinto for supporting the depending tubular shaft for rotation thereupon with the remainder of the tubular shaft depending below the roof opening a sufficient extent to span the separation between the roof panel and interior panel or ceiling of the structure or vehicle. This connection is to be suitably caulked or sealed against leakage upon rotation of the tubular shaft imparted by an elongated attached lower handle formation located interiorly of the dwelling or vehicle.

Another feature resides in providing an annular plate whose circumference on the exposed lower surface is marked out in azimuth, with points of the compass inscribed, similar to an azimuth instrument or azimuth bar. This annular azimuth plate surrounds the lower end of the tubular column in close proximity to but below the interior ceiling or panel of the dwelling or vehicle and is mounted between anchoring plates supporting the tubular shaft from below. The azimuth plate is mounted for rotational displacement therearound so as to present the markings for establishing the magnetic or true south setting at any given site.

Further, the elongated lower handle formation is secured to the tubular shaft below the azimuth plate so that the handle formation is aligned with the channel-shaped formations carrying the dish and associated feed horn whereby the direction of the dish and horn can always be reckoned from within the dwelling or the vehicle and releasably secured in relation to the azimuth plate markings against displacement.

Given that coordinates for the reception of signals from designated satellites in any given area are published either by broadcasting sources or other media the foregoing mounting can be readily adjusted so as to align the external components in a direction and inclination to best intercept signals generated by a specific satellite.

Since precise elevation of the dish and associated feed horn is a controlling characteristic for optimum reception of signals that step is readily accomplished through rotation of the worm by means of a second handle formation attached thereto and spaced below the tubular column and elongated directional handle formation. By rotation applied in one direction to the worm and to the worm gear of the offset linkage, upper channel-shaped formation is incrementally displaced upwardly to the point where the inclination places the dish and feed horn or LNB in optimum disposition for reception of signals.

A further feature resides in providing a screw threaded clamping mechanism to releasably lock the components against displacement and maintain the optimum position once achieved which mechanism is carried at the lowermost end of the externally threaded post or worm for ready manipulation.

Thus are the necessary but simplified controls for orienting and fixing the external components of the structure all presented within the building or vehicle. These and other objects and features of the invention are apparent in the following description to be read in conjunction with the sheets of drawings illustrating the preferred embodiment.

THE DRAWINGS

Figure 4:
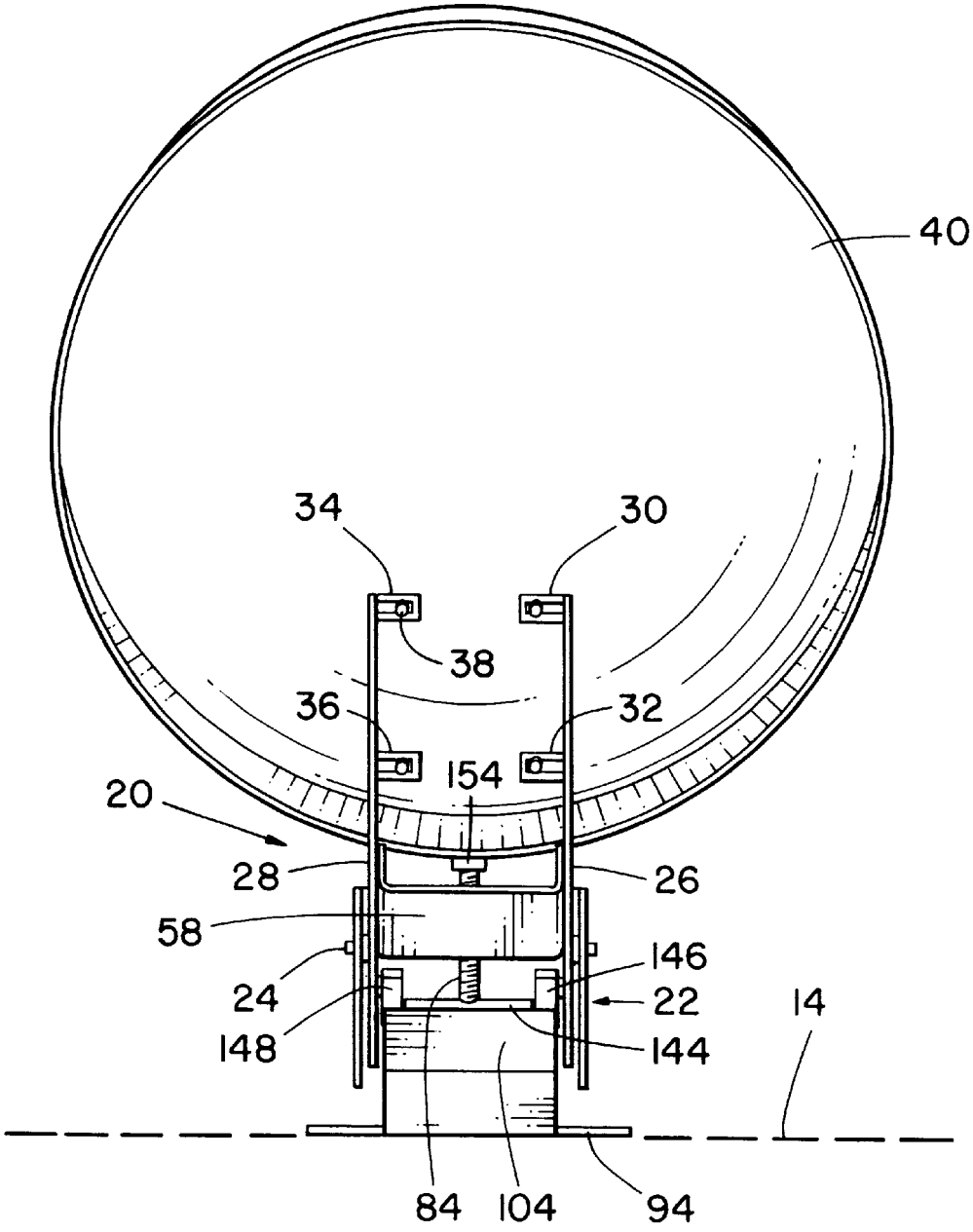
FIG. 4 is a rear elevational view of the assembly of FIGS. 1, 2 and 3.
Figure 5:
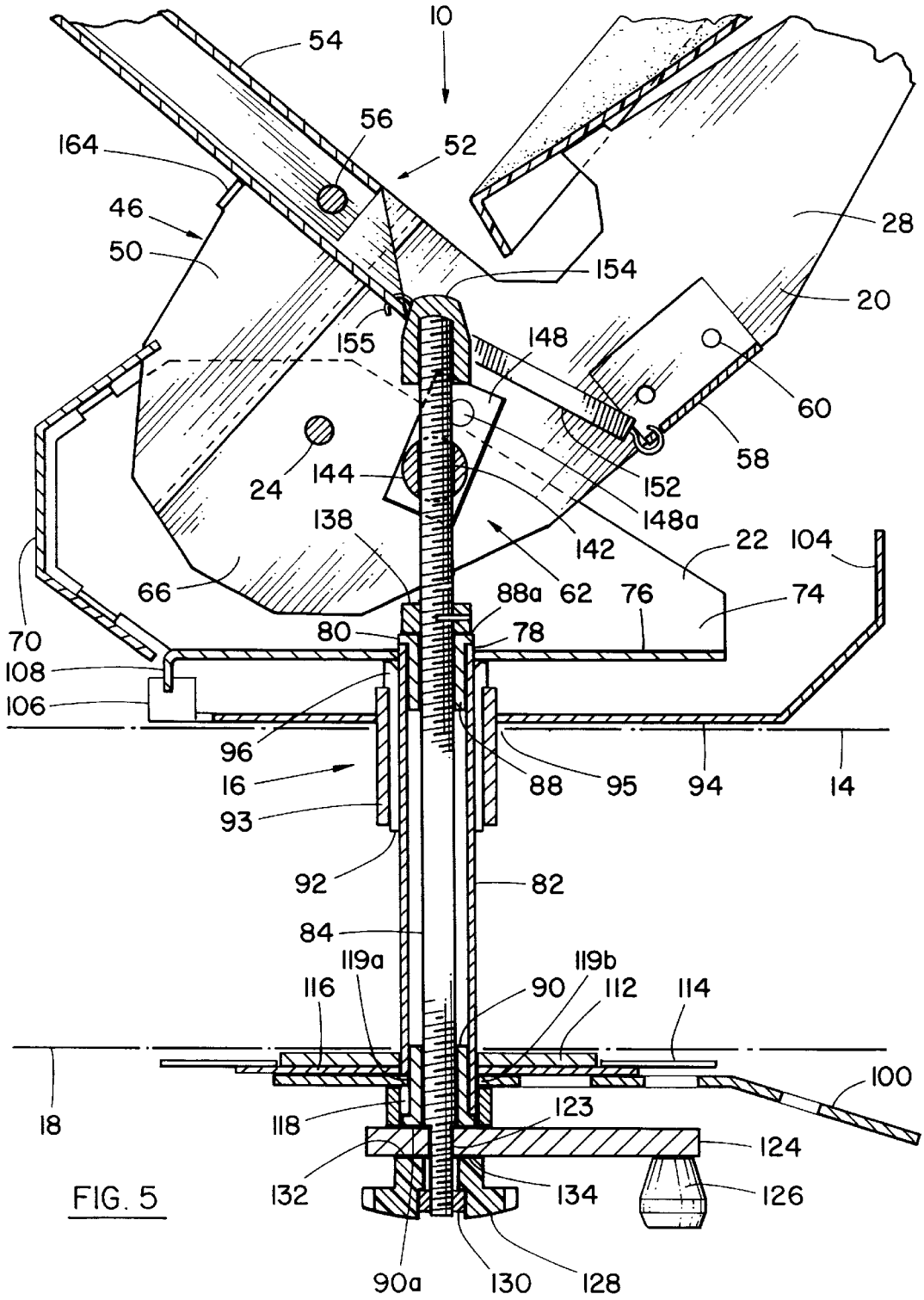
Figure 6:
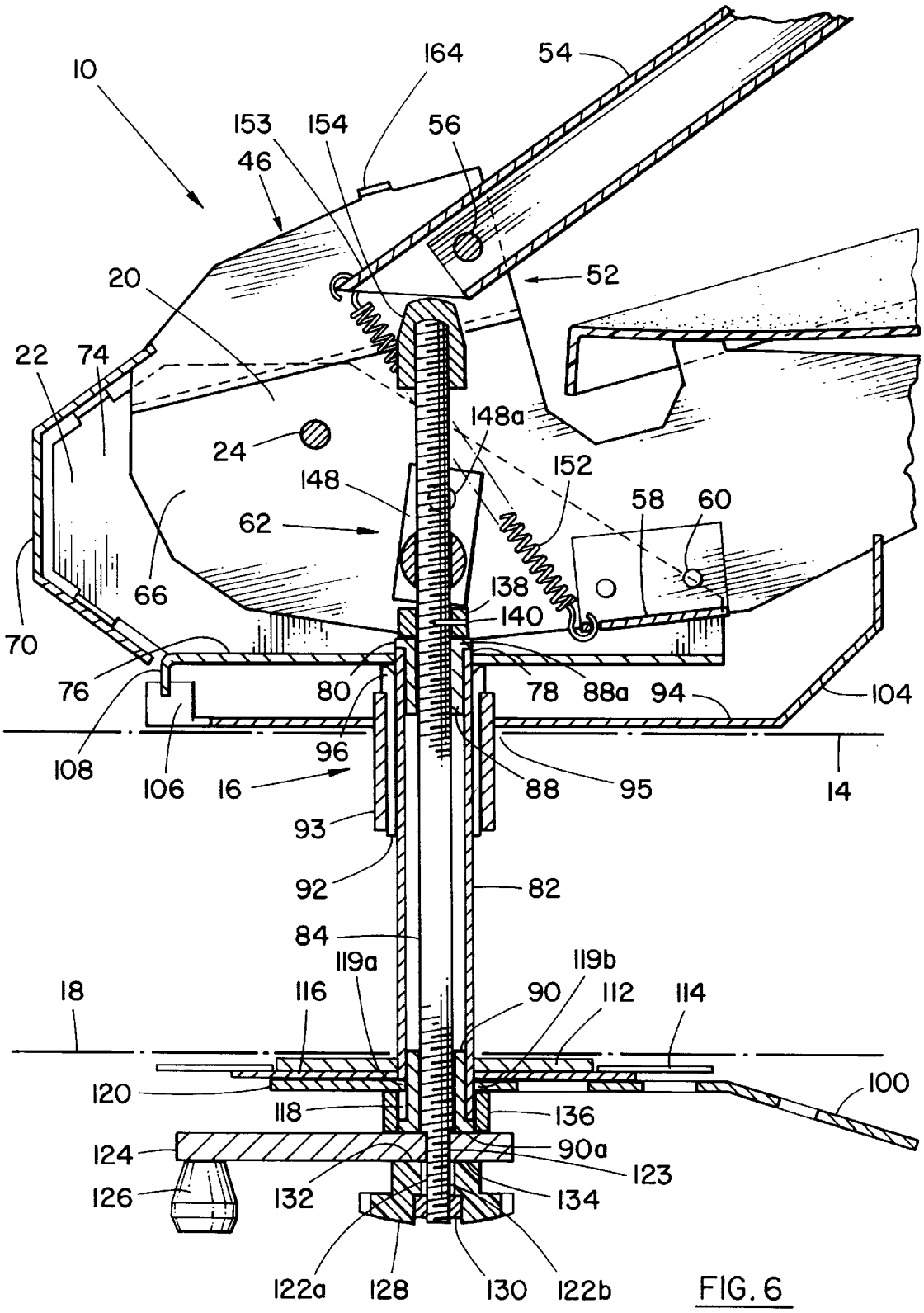

FIG. 5 is a vertical cross-sectional view of the components of the satellite dish assembly in the angled disposition detailed in FIGS. 1 and 2 and including those elements of the instrumentation for controlling orientation which extend below the roof line not shown in FIGS. 1 to 4, which bridge the separation between the outer roof panel and inner ceiling panel, with the dish and arm or column for the feed horn or LNB and other supporting framework partly broken away;

FIG. 6 is a vertical cross-sectional view of the assembly similar to FIG. 5, in which the instrumentation has been displaced as compared with FIG. 5, so as to move the associated components in a direction to collapse the assembly.

Figure 7:
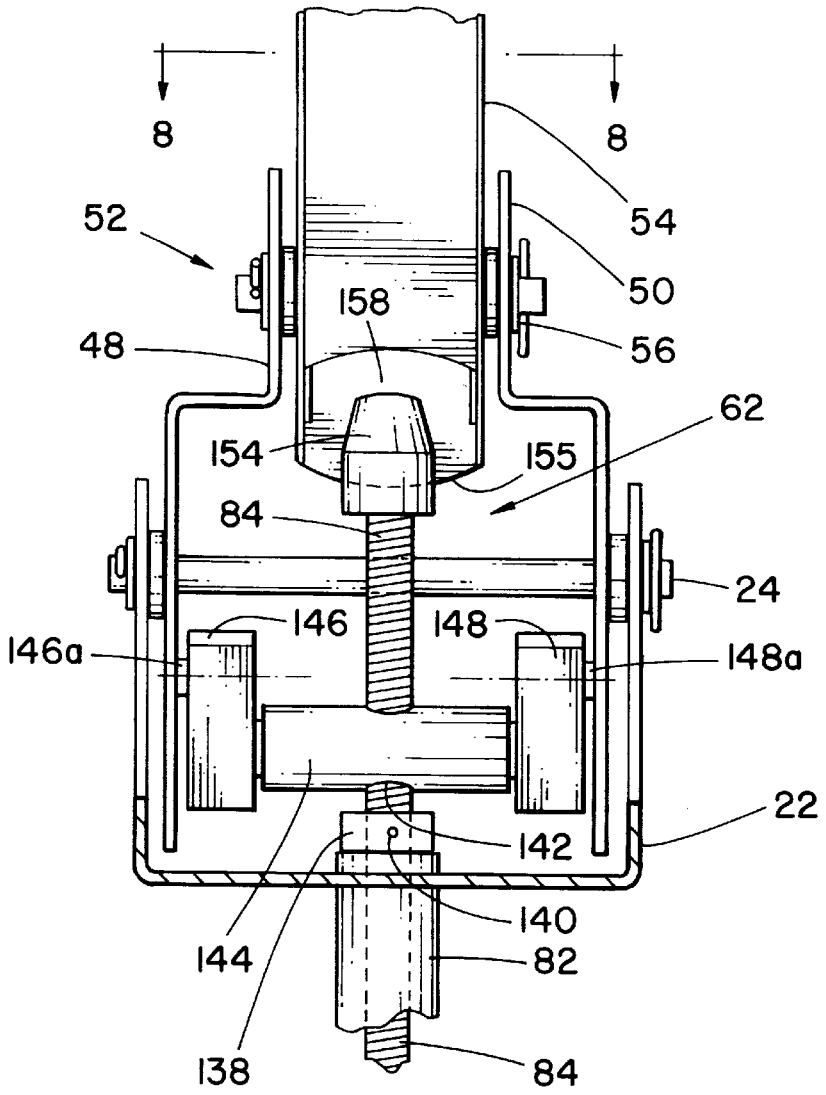
Figure 8:
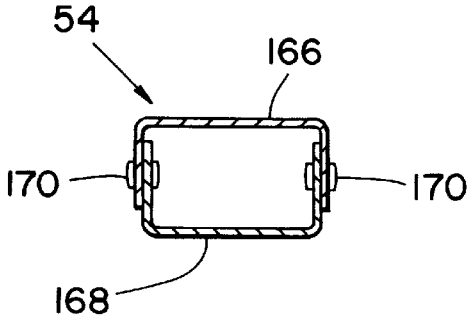
Figure 9:
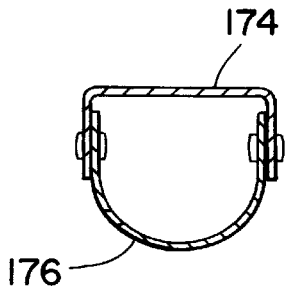
Figure 10:
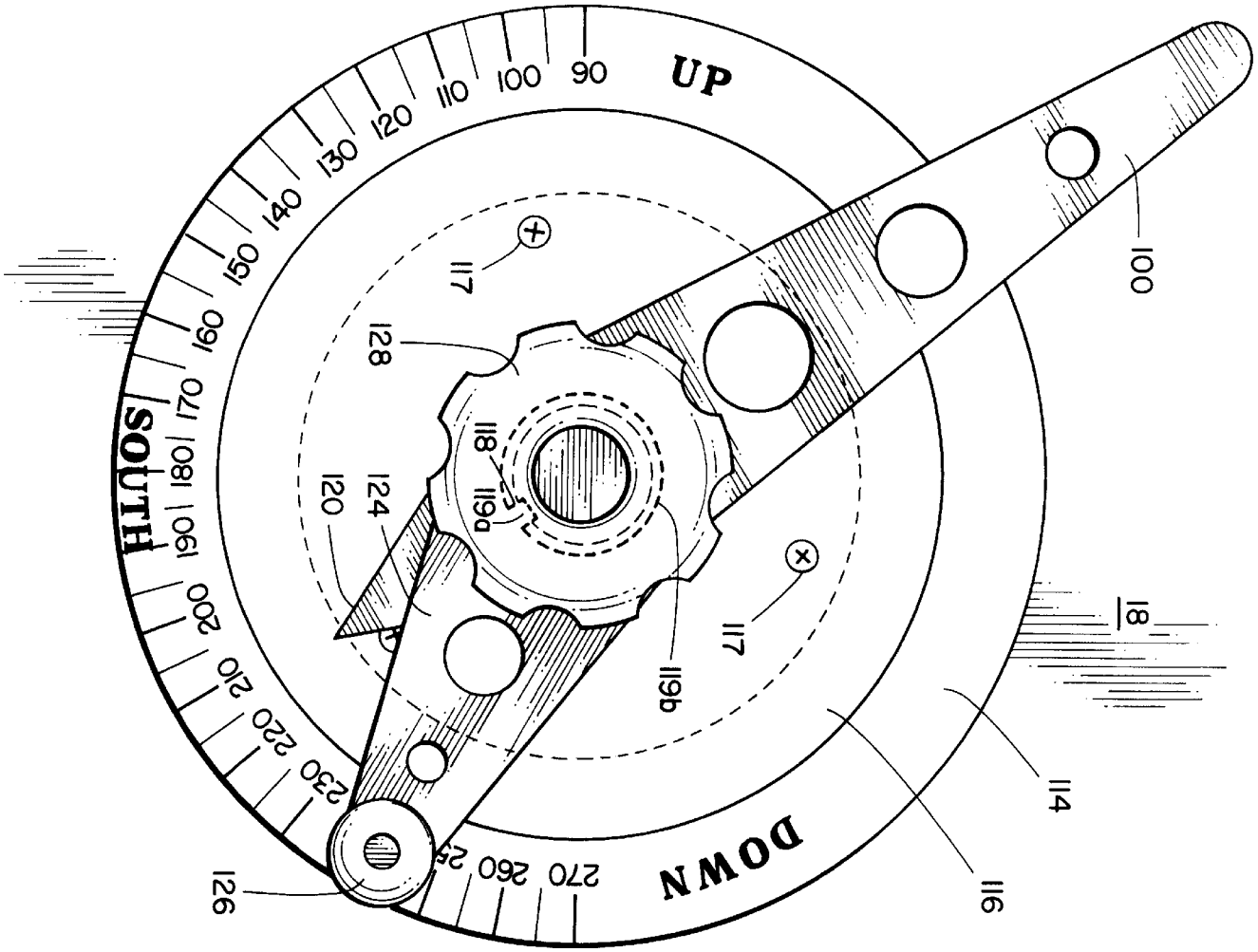

FIG. 7 is a top plan view of the central upper region of the external components shown in FIGS. 1 to 4 with the surrounding structure broken away;

FIG. 8 is a cross-sectional view of the displaceable arm or column that supports the feed horn or LNB of the assembly of FIGS. 1 to 7, taken along the line 8—8 of FIG. 7;

FIG. 9 is a cross-sectional view of an alternative or substitute structure for the arm or column of FIG. 8, whose configuration has been selected to accommodate alternate or substitute feed horns or LNB's for the reception of signals from different satellites;

FIG. 10 is a bottom plan view of the assembly, taken from below, as depicted in FIGS. 5 and 6, to reveal the character, shape and placement of those components to be manipulated and rotated or swung so as to ultimately fix the position of the dish and feed horn from within the building, dwelling or vehicle, as the case may be.

THE PREFERRED EMBODIMENT OF THE INVENTION

The satellite dish assembly 10, illustrated in FIGS. 1 to 4, and as more particularly depicted in FIGS. 5 and 6 of the drawings, is comprised of an arrangement of interconnected external components, generally indicated at 12, to be exposed above the roof 14 of a building, dwelling or vehicle, coupled with an arrangement of internal interconnected components, generally indicated at 16 in FIG. 5 and 6 to extend from below the roof 14 to within the building, dwelling or vehicle, and terminating below the ceiling panel 18 thereof, shown in broken outline.

More particularly, the external arrangement includes an upper channel-shaped formation 20, nestable within a lower channel-shaped formation 22, and supported therewithin for swinging movement on a pivot connection 24 so as to extend under displacement upwardly to a substantially upright angled disposition and reversely.

Upstanding side walls 26, 28, of upper channel-shaped formation 20 are configured at one end to present inwardly opposed spaced-apart paired apertured lugs 30, 32 and 34, 36, as revealed in FIG. 4, for the reception of correspondingly located threaded shafts of suitably headed bolts 38, or other such fasteners presented by an upwardly opening parabolic dish-shaped element or dish 40 of the assembly 10. Thus with suitable lock or wing nuts (not illustrated) to bear against the lugs 30, 32 and 34, 36, dish 40 can be releasably clamped thereto.

By contouring each opposed wall, 26, 28, respectively, as indicated at 42, 44, a four-point support and connection is established between dish 40 and upper channel-shaped formation 20 which rigidifies and hence stabilizes the structure. As well, through such arrangement the steps of assembly are simplified.

Figure 1:
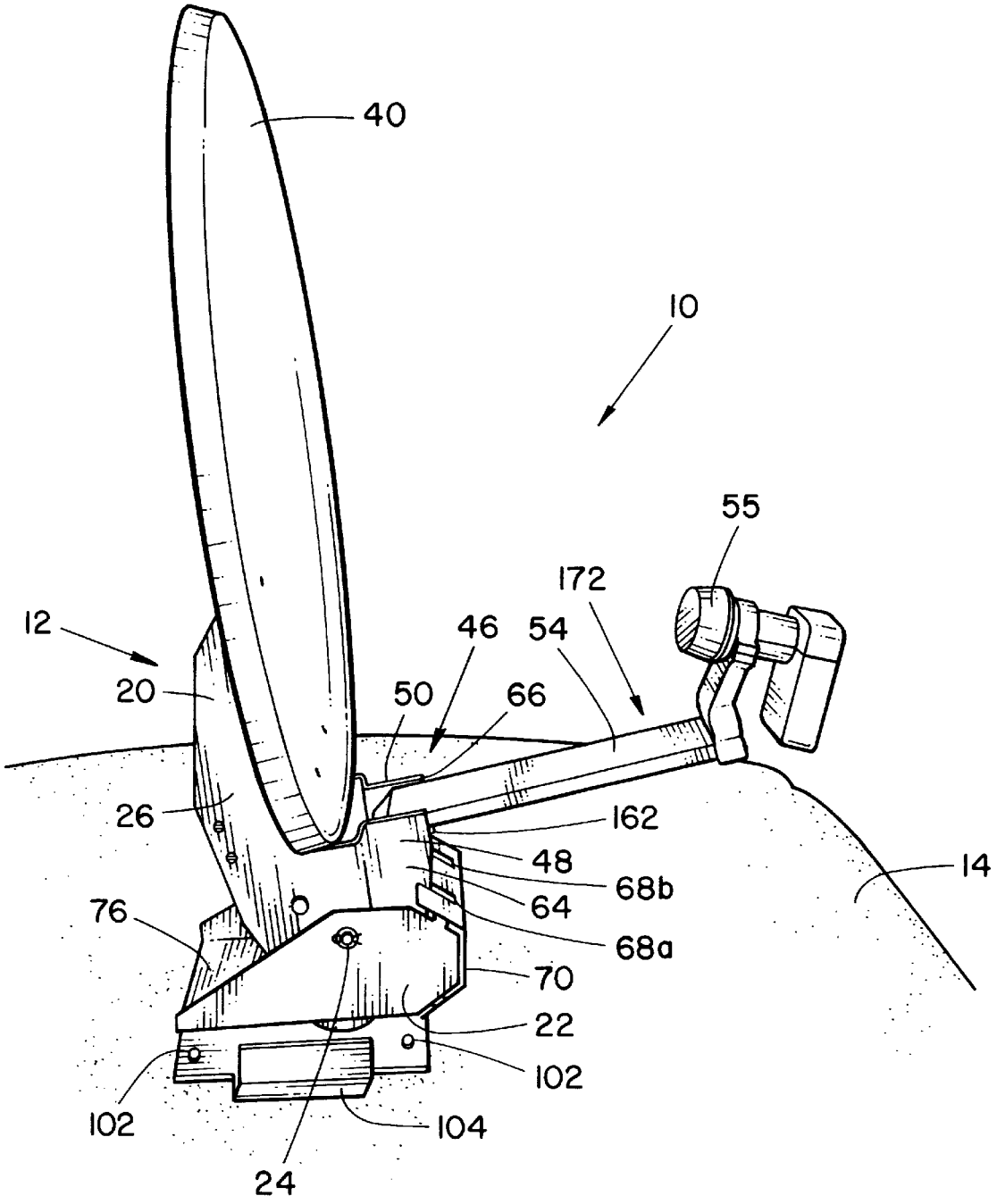
FIG. 1 is a perspective view of the external components of the satellite dish assembly mounted upon the roof of a building, dwelling or vehicle in which the dish and associated feed horn are shown in an elevated disposition.

Side walls 26, 28 of upper channel-shaped channel formation 20, at the end 46 opposed to lugs 30, 32 and 34, 36 as indicated in FIGS. 1, 5 and 6 are configured to upstand well above both the lower channel-shaped formation 22 as well as the opposed end of upper channel-shaped formation 20, and are folded inwardly and are upwardly contoured to present opposed projection portions 48, 50, arranged in parallel relation, sufficiently separated so as to receive, support and preferably guide the lower end 52 of arm formation or column 54 for swinging movement therebetween on a suitable pivot structure 56, which arm formation 54 carries the feed horn or LNB 55 at its upper end, all as more particularly detailed in FIG. 7.

Upper channel-shaped formation 20 includes a narrow bottom wall panel 58, suitably secured or connected to opposed side walls 26, 28, as by fasteners 60 or by welding.

Bottom wall panel 58 has a limited extent longitudinally of the side walls 26, 28 so as to establish a passageway to accommodate the upper extent of the elements of operating mechanism 62 located generally centrally thereof for controlling displacement of the upper channel-shaped formation 20. This arrangement also facilitates, when upwardly angled, as indicated in FIG. 1, the registration of the extremities of side walls 26, 28 as at 64, 66, respectively, within anchoring slots 68*a*, 68*b* formed in end wall 70, of lower channel-shaped formation 22. In that manner the structure or assembly 10 is reinforced against dislodgement under wind forces and generally stabilizes the external components 12 in that disposition. End wall 70 also serves to limit access to the centrally located internal mechanism 62 and so protects same from damage through contact with debris carried by wind forces and the like.

Upstanding side walls 72, 74 of lower channel-shaped formation 22 have a lesser longitudinal dimension as compared with side walls 26, 28 of upper channel-shaped formation 20 and have a configuration in relation to end wall 70, such that end wall 70 wraps around in an angled arrangement, two of which angles present opposing lugs for securing end wall 70 to side walls 72, 74, either by suitable fasteners or by welding.

Bottom wall panel 76 of lower channel-shaped formation 22 is provided with a central opening 78, in which the upper open end 80 of a tubular shaft formation 82 registers, which open ended shaft formation 82 completes the upper passageway and serves as a housing for elongated threaded rod formation or worm 84 of the internal mechanism 62 and as an element of the rotational support for external components 12.

Both tubular shaft formation 82 and worm 84 have an axial extent below the roof 14 of the order to bridge the separation between the roof and ceiling panel 18 of a building, dwelling or vehicle and to present the lower ends thereof below the ceiling panel 18 as will be described.

Worm 84 in turn is aligned for rotation within tubular shaft formation 82 by suitable metal bushings 88, 90, respectively, telescoped therein at each end thereof, with the rims or crowns 88*a*, 90*a*, respectively, bearing against opposed ends of tubular shaft formation 82 as illustrated in FIGS. 5 and 6.

The upper end of tubular shaft formation 82 slightly protrudes through bottom wall panel 76 of lower channel-shaped formation 22 and is attached as by welding to the lower surface thereof.

Tubular shaft formation 82 is supported within a bushing 92 of a rigid sleeve or collar 93, presented centrally and integral with an anchor plate 94. Anchor plate 94 is mounted upon roof 15 with collar 93 registering within an appropriately shaped opening 95 extending through the roof 14 whereby upper and lower channel-shaped formations 20, 22 are supported for displacement about a substantially vertical or upright axis and throughout approximately 360 degrees.

Bushing 92 derived from nylon or other suitable resilient material of requisite hardness has an upper annular shoulder 96 to underlie the region of bottom wall 76 of lower channel-shaped formation 92 surrounding the connection to tubular shaft formation 82. In that manner an appropriate support and seal against entry of moisture, water or fluid can be provided, yet allows for rotation imparted to tubular shaft formation 82 by an elongated handle formation 100 connected to its lower end.

Anchor plate 94 is apertured at spaced intervals near its periphery as at 102, seen in FIG. 1, for the reception of suitable threaded fasteners to secure same to the roof 14 of building or vehicle.

At one end anchor plate 94 is provided with an upwardly angled and transversely extending wall 104 corresponding in configuration to end wall 70 of lower channel-shaped formation 22. Wall 104 is both positioned and dimensioned so as to closely register within the separation of side walls 26, 28 of upper channel-shaped formation 20 below dish 40 when lowered into the nested disposition of FIG. 3. Thus in such disposition are the upper and lower channel-shaped formations 20, 22 and anchor plate 94 brought into and maintained in alignment.

Also, through appropriate dimensioning wall 104 does not obstruct rotation imparted to the upper and lower elongated channel-shaped formation 20, 22 by tubular shaft formation 82 when upper channel-shaped formation 20 is elevated out of registration with and above wall 104 so as to properly orient same in the direction of the satellite.

Also a lug 106 struck from anchor plate 94 upstands centrally at the opposite end to wall 104 which lug 106 serves as a stop to engage depending lug 108 struck down centrally from bottom wall 76 of lower channel-shaped formation 22 below slotted end wall 70 and to thereby reinforce the requisite alignment when fully nested, and otherwise limit rotation to approximately 360 degrees in either direction.

With such arrangement the external components 12 are suitably reinforced and constrained against dislodgement under the action of wind forces particularly when mounted upon the roof of a vehicle such as an RV which during travel also will be subjected to vibration and the forces of air streams generated by vehicle movement.

As will be observed in FIGS. 5 and 6 the axial extent of tubular shaft formation 82 is such that its lower end lies below ceiling panel 18, a distance sufficient to accommodate the elements at lower end for controlling, from within, the disposition of external components 12.

An annular centering plate 112 receives the lower end of tubular shaft 82 for disposition immediately below ceiling panel 18 and is adapted to abut same and to be secured thereto so as to properly support and align tubular shaft formation 82 within collar 93 under the application of torque through lower elongated handle formation 100.

Surrounding centering plate 112 is a thin annular plate 114 in closely spaced radial relation thereto for controlled displacement therearound by manipulation.

As shown in FIG. 10 of the drawings annular plate 114 is inscribed with azimuth markings from 90 to 270 degrees and includes the designations "SOUTH" and "UP" and "DOWN".

In the northern hemisphere such an arrangement is appropriate in that the broadcasting satellites are in an orbit over the equator and therefore the precise direction for the dish 40 to be ascertained can be accomplished through the use of a compass or other equivalent instrument to establish the "SOUTH" setting of annular azimuth plate 114. This setting is the basis for then establishing the requisite direction or orientation of dish 40 and feed horn or LNB 55 to move same to the position for reception set forth in the published data or otherwise determined by applying torque to tubular shaft formation 82 by means of elongated handle formation 100 to fine tune same.

As observed in FIGS. 5, 6 and 10 cover plate 116 is in the form of an annulus having an outer radius exceeding that of the annular centering plate 112 but limited in extent so as to expose the indicia of the azimuth plate 114 underlying both centering plate 112 and azimuth plate 114. Cover plate 116 is suitably apertured as at 117 which corresponds to apertures (not illustrated) in centering plate 112 for securing same together and to ceiling panel 18 of the building or vehicle but leaving a circumferential slot with sufficient clearance for retaining azimuth plate 114 therein for displacement therearound.

Adjacent the lower end of tubular shaft formation 82 an axially extending slot 118 is provided which is adapted to receive and mate with a lug or key 119*a* presented so as to extend into opening 119*b* of elongated handle formation 100 which opening 119*b* is shaped to fit over and closely engage the circumference of tubular shaft formation 82 in that region.

Axially extending slot 118 is so contoured and positioned that when key 119*a* is fully engaged therein elongated handle formation 100 is aligned with the central longitudinal direction of upper and lower channel-shaped formations 20, 22.

Hence with this arrangement the direction of the dish 40 carried by the upper channel formation 20 is known from within the building or vehicle.

Elongated handle formation 100 is provided with a pointed end 120 serving as an indicator for the positioning of the dish 40 in relation to azimuth plate 114, as seen in FIG. 10, whereby the dish 40 is oriented in the requisite direction indicated by the published coordinates for the particular broadcasting satellite in the site or area of reception of signals or otherwise determined by the operator.

A relatively thick suitably dimensioned annular band 121 of material such as Nylon® or an equivalent underlies the connection of elongated handle formation 100 to tubular shaft formation 82 and maintains same in the relationship illustrated and serves to space same from the lower handle formation or crank 126 as will now be described.

Lowermost threaded rod formation or worm 84 is contoured to present opposed parallel flattened surfaces 122*a*, 122*b*, to form a stem or key which closely registers within a correspondingly shaped opening 123 in the shaft 124 of crank 126.

An appropriately contoured hand-gripping clamp 128 is provided with an internally threaded passage in the form of a nut or connector 130 as depicted in FIGS. 5 and 6 for threadably engaging the lowermost end of threaded rod formation or worm 84 to establish and maintain the connections between handle formation 100 and tubular shaft formation 82 and between crank 126 and worm 84.

Under rotation to displace hand-gripping element 128 upwardly the upper surface 132 thereof will bear against the centrally located lower surface 134 of shaft 124 in clamping engagement therewith which acts to restrain or inhibit rotational movement of crank 126, thereby fixing the position of worm 84 and hence, as will be later noted, the inclination of dish 40 and associated feed horn or LNB 55.

Likewise under such clamping engagement tubular shaft formation 82 is restrained or inhibited against displacement through clamping contact of the upper surface 136 of shaft 124 of crank 126, with crown 90*a* of the bushing 90 which bears against the lower end surface of tubular shaft 82 and spacer band 121.

Upon release of hand-gripping element or clamp 128 from clamping engagement crank 126 and elongated handle formation 100 are freed to impart rotation to the worm 84 and tubular shaft formation 82 in either direction and so again position the dish 40 and associated feed horn 55.

A fitting or nut 138 appropriately threaded onto the worm 84 above tubular shaft formation 82 assumes the disposition shown in FIGS. 5 and 6 and bears upon the crown 88*a* of bushing 88. Through a set screw 140 presented by the fitting or nut 138 or its equivalent nut 138 fixedly engages worm 84 in such position. Thus threaded nut 138 upon rotation of worm 84 will rotate therewith and bear against the crown 88*a* of bushing 88 which together with hand gripping element 128 effectively prevents axial displacement of worm 84 within tubular shaft formation 82 under rotation by crank 126.

As shown in FIGS. 5 and 6 externally threaded worm 84 engages within an internally threaded open ended displaceable worm gear 142 presented by a generally cylindrically shaped transversely extending link or bar 144 which is mounted for rotation between aligned suspended links 146, 148 each pivotally carried by opposed side walls 26 and 28 of upper channel-shaped formation 20 as at 146*a*, 148*a*.

The aligned pivotal connections 146*a*, 148*a* of links 146, 148 are so secured to respective side walls 26, 28 of upper channel-shaped formation 20 in offset relation to the pivot connection 24 of lower channel formation 22 such that upon rotation of worm 84 by crank 126 in one direction worm gear 142 is displaced axially of worm 84 downwardly as depicted in FIG. 6, from the position shown in FIG. 5. Thus upper channel-shaped formation 20 is urged towards a nesting relationship within lower channel-shaped formation 22 with the lower limit position disclosed in side elevation of the external components 12 in FIG. 3 and reversely when worm 84 is rotated in the other direction.

Upon reaching the nested disposition hand-gripping element or clamp 128 can be rotated to move upwardly into full clamping relationship with the lower surface of shaft 124, and urge the upper surface of shaft 124 against the lower surface of crown 90*a* and the lower end surfaces of tubular shaft formation 82 and spacer band 121 thereby constraining external components 12 against dislodgment.

When clamp 128 is released and worm 84 rotated in the opposite direction by crank 126 the worm gear 142 is axially displaced upwardly thereof, thereby swinging upper channel-shaped formation 20 about pivot connection 24 to a substantially upright disposition that affords optimum targeting by dish 40 of signals generated by a selected satellite.

It will be observed from FIG. 5 that the side walls 26, 28 of upper channel-shaped formation 20 in the inclined disposition clear the transversely extending upstanding wall 104 of anchor plate 94 so that the channel-shaped formations 20, 22 and arm 54 above the anchor plate 94 are free to swing throughout almost 360 degrees, limited only by the contact of lug 104 with lug 108.

As upper channel-shaped formation 20 is elevated arm formation 54 supporting the feed horn or the LNB 55 is swung about its pivot 56 under the action of compression spring 152 secured between the lower protruding edge 153 of arm 54 and bottom wall panel 58 of upper channel-shaped formation 20 and into a position at generally right angles thereto for optimum reception of reflected signals from dish 40.

The upper end of worm 84 is provided with an enlarged suitably anchored cap or knob 154 of a resilient wear resistant material having a substantial degree of hardness, such as Nylon or a compound identified by the trademark NYLA-TRON®. Knob 154 is so contoured and dimensioned as to bear upwardly against the lower protruding edge 155 of arm 54 when swung to present feed horn or LNB 55 at the focus of parabolic dish 40. This contact maintains arm 54 in such position for the reception of signals as depicted in FIGS. 1, 2 and 5 and will bear upwardly against the inner exposed surface 158 of outer wall 160 of arm 54 when swung downwardly into the collapsed disposition under the force exerted by compression spring 152 to thereby urge feed horn 55 towards contact with the upper surface of dish 40.

With such arrangement the positions of arm 54, feed horn 55 and dish 40 in either the extended or collapsed disposition are sufficiently stabilized for reception or storage.

Additionally in such extended position arm or column 54 is supported from below by lugs 162, 164 struck inwardly from side walls 26, 28 of upper channel-shaped formation 20 so as to limit its descent and maintain the precise relationship of dish 40 to feed horn 55.

It will be observed from FIG. 8 that the arm 54 is comprised of opposed suitably dimensioned channel-shaped elements 166, 168, secured at abutting side walls by rivets 170.

Figure 2:
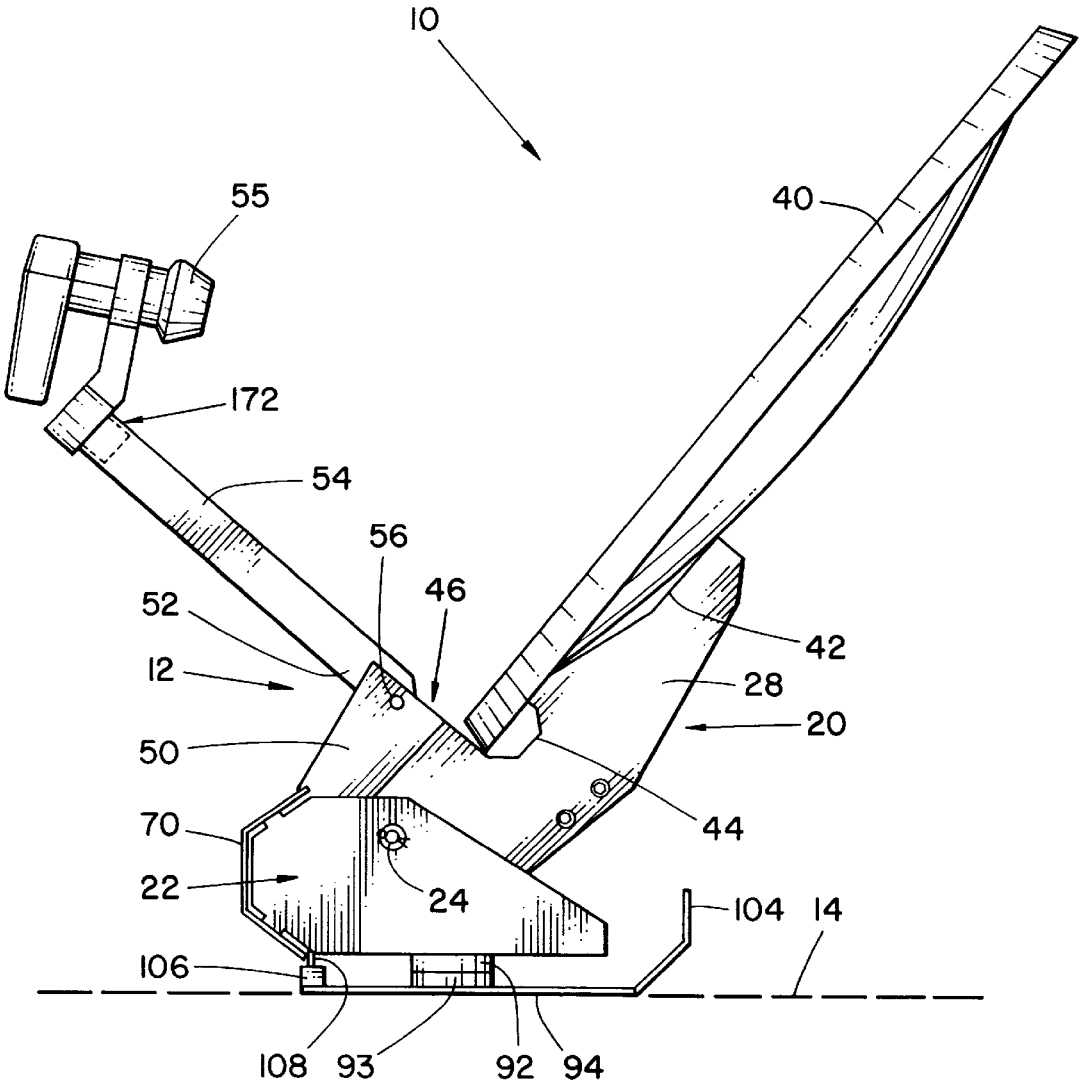
FIG. 2 is a side elevational view of the external components of the satellite dish assembly of FIG. 1 taken from the right side thereof.

The generally rectangular cross-section of tubular arm or column 54 has been dimensioned so as to accept the shape of the protruding foot or support 172, see FIG. 2, of a selected feed horn or LNB 55 for a particular receiver in close registration and to be releasably secured therein by a suitable screw-threaded fastener or the like (not shown).

The structure of the arm 54 permits the ready substitution at the outer end thereof of a removable panel or segment such as curvate component 176 as depicted in cross-section in FIG. 9, for readily securing a differently-shaped foot (not shown) of an alternative or substitute feed horn or LNB required in the case of the selection of a different receiver for a specified satellite.

Thus can such structure be modified to accommodate reception from alternative broadcasting satellite sources if so desired.

The cables and connections (not shown) linking the feed horn or LNB to the receiver for conducting signals generated by the broadcasting satellite can be incorporated into the structure of the external components 12 by selecting suitable lengths of same and using the central passageway of the arm or column 54 as a conduit with the cable then taken through the roof 14 into the building or vehicle in sufficiently spaced relation thereto so as to not inhibit or interfere with rotation and elevation of the external components 12 under displacement by the respective elongated handle formation 100 and crank 126.

INSTALLATION OF THE SYSTEM

The system 10, will be mounted upon a selected generally horizontal section of a roof 12 of a building or dwelling and will have an appropriate exposure towards the southern sky in the northern hemisphere. Opening 95 formed in the roof 12 of the building or vehicle penetrates the ceiling 18 and generally matches the shape of integral sleeve or collar 93 of anchor plate 94.

The collar 93 and anchor plate 94 are suitably sealed against leakage within opening 95 and anchor plate 94 secured in a selected disposition upon roof 12 by fasteners 102.

The lower annular plates 112 and 116 are likewise to be secured to the ceiling panel 18 from below in generally vertical alignment with the collar 93, as earlier disclosed, and with azimuth plate 114 held therebetween for manual displacement therearound in the defined slot or channel.

Upper and lower channel-shaped formations 20, 22 mounted upon tubular shaft formation 82 together with associated pivoted arm 54 and linkages 144, 146, 148 are then readied for disposition upon the rim of bushing 92, telescoped within collar 93 and with shaft 82 depending therebelow.

It is to be noted that slot 118 at the lower end of tubular shaft 82 lies in a longitudinal plane generally bisecting the upper and lower channel-shaped formations 20, 22 when disposed in nested relation.

The extent of tubular shaft 82 has been selected so as to bridge the separation between the roof panel 14 and ceiling panel 18 of any structure with the lower end of shaft 82 registering within the central openings of annular plates 112, 114, 116, with plates 112, 116 then secured to ceiling panel 18 when aligned with collar 93.

The upper and lower ends of tubular shaft formation 82 are then fitted with bushings 88, 90, respectively, and the worm 84 readied for engagement from above, firstly, with internally threaded worm gear 142 of link 144 and then with the threaded nut 138.

The threaded nut 138 is then positioned on worm 84 so that the extremity of the shaft or worm 84 extends below upper bushing 88 to a point sufficiently beyond lower bushing 90 within the lower end of tubular shaft formation 82.

Figure 3:
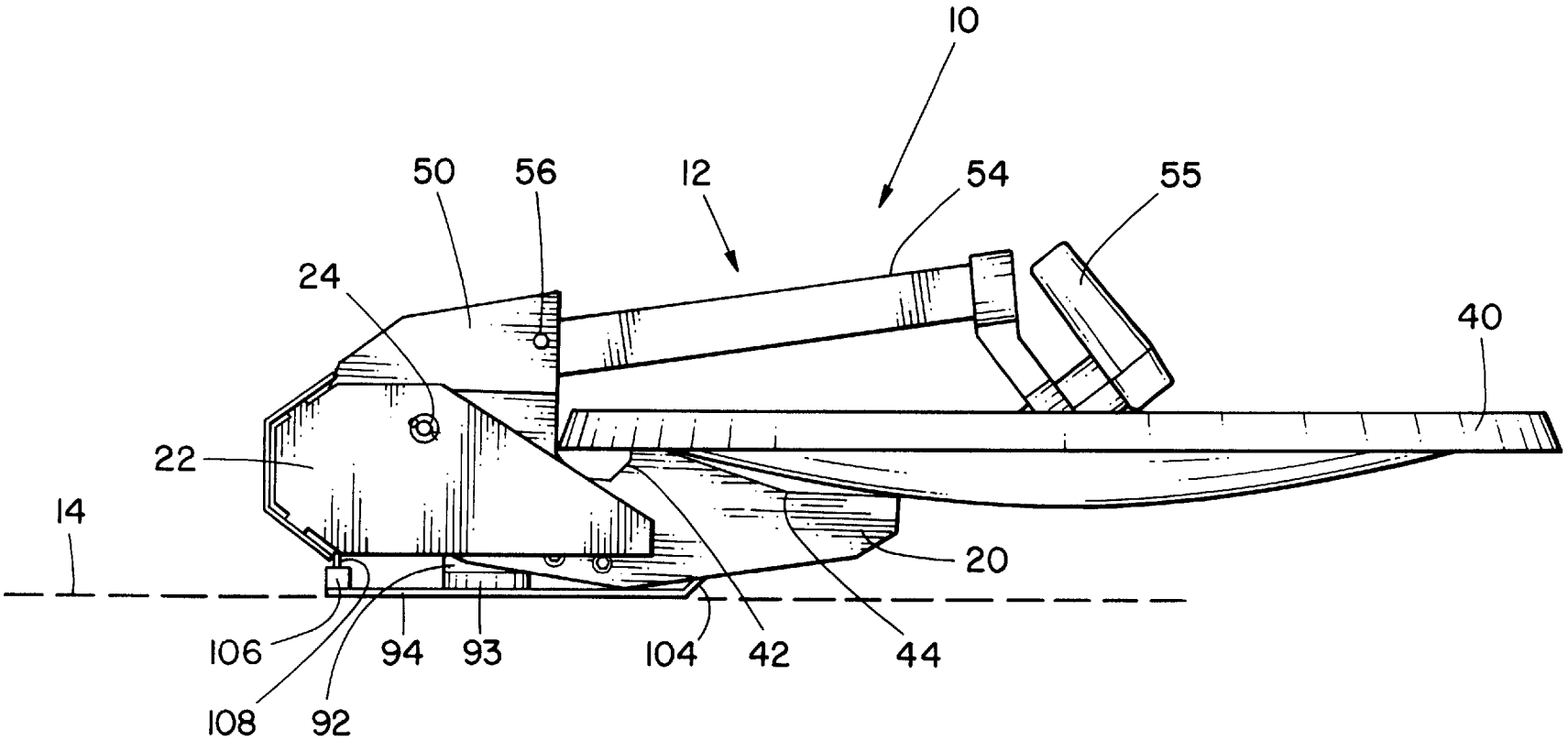
FIG. 3 is a side elevational view similar to FIG. 2 wherein the dish associated feed horn and supporting framework of the mounting are shown in collapsed disposition.

The longitudinal extent of threaded post or worm 84 has been dimensioned so that the extent of the portion above nut 138 is sufficient to place knob 154 into engagement within the lower edge 155 of arm 54 as shown in FIG. 5, and to engage the inner exposed surface 158 of arm 54 when the external components 12 are in the fully collapsed or nested disposition shown in FIG. 3.

Nut 138 is then secured against displacement on worm 84 by set screw 140.

At the lower end of tubular shaft formation 82 the threaded post or worm 84 is centred by bushing 90 with the stem portion extending therebelow.

At that stage the opening 119*b* of handle formation 100 is then applied with lug 119*a* keyed into slot 118 of the tubular shaft 82 and slides upwardly to bear against annular plate 116.

The spacer band or element 121 is then applied over the lower end of tubular shaft formation 82. The dimensions of spacer band or element 121 are such that its lower surface lies generally in the plane of the lower surface of the rim 90*a* of bushing 90.

The lower stem of the threaded post formation or worm 84 protrudes below the lower surfaces of spacer band 121 and rim 90*a* in position to receive the configured opening 23 of shaft 124 of crank 126 in full registration therewith and to bear against the aforementioned surfaces in the manner depicted in FIGS. 5 and 6.

To the lowermost end of the threaded post formation or worm 84 clamp 128 is then applied with nut 130 engaging the threaded portion of the stem to move upwardly upon rotation to engage the lower surface of shaft 124 of crank 126.

Loosening off the clamp 128 enables the operator to readily displace handle formation 100 or to rotate crank 126 to achieve the requisite orientation and elevation of dish 40 and feed horn or LNB 55 mounted upon the arm 54.

Dish 40 can then be secured to the mounting on channel-shaped formation 20 as earlier described and the feed horn or LNB 55 to the upper end of arm 54 with attached cables threaded down the hollow arm 54 and secured in position as earlier described.

The cables in spaced relation are then taken through the roof 14 to the interior, all in a well-known manner, for connection to the selected receiver, compatible with the feed horn or LNB 55.

The gauge of the screw threads in the mounting of assembly 10 will be selected for a given model so as to achieve the requisite elevation and fully collapsed disposition by the turning of crank 126 through several revolutions with relative ease.

The selected gauge will determine the ultimate position of crank 126 when the dish 40 and associated elements are fully elevated and when they are fully collapsed. Thus such position of crank 126 can be designated as "UP" for full elevation and "DOWN" for collapsed or nested disposition as shown on azimuth plate 114 in FIG. 10.

OPERATION

The position of assembly 10 in terms of optimum reception of signals from a designated satellite is established first by displacement of the azimuth plate 114 to a position where South coincides with the compass direction or a direction finder signifying south, suitably corrected for any distortion.

When clamp 28 is loosened off crank 126, by being turned in one direction, it will elevate the upper channel-shaped formation 20 from the nested disposition above the angled upstanding wall formation 104 of anchor plate 94 freeing the upper and lower channel-shaped formations 20, 22 for rotation.

The dish 40 can then be aimed or oriented by applying torque to tubular shaft formation 82 through handle formation 100 in accordance with published coordinates pertaining to the position of the selected broadcasting satellite in relation to the site or area in which the assembly 10 is located through placing the pointed end 20 of handle formation 100 generally in the region of the denoted azimuth marking pertaining to such satellite coordinates.

Then by rotation of crank 126 the dish and associated components can be further elevated to an inclination which intercepts the signals generated and then having regard to the monitor or other instrumentation the position find-tuned to optimize reception whereupon the clamp 128 can then be applied to fix the positions.

When the external components are to be collapsed and stored in the nested disposition steps in reverse are executed. Again, clamp 128 is applied to fix the components and so secure the assembly against dislodgement.

It will be understood that the preferred embodiment of the invention has been described and illustrated, and that persons skilled in this field may alter or vary the arrangement or relationships disclosed without departing from the spirit and scope of the invention as defined in the appended claims.

What I claim is:

1. In a collapsible roof mounting for supporting and orienting a satellite dish system in relation to a broadcasting satellite from below the roof, upper and lower nestable channel-shaped formations, each including a bottom portion joining upstanding spaced-apart sidewall portions and interconnected adjacent one end thereof for swinging movement of said upper channel-shaped formation from a generally horizontal nested disposition within said lower channel-shaped formation to an upwardly projecting angled disposition thereto and reversely, and wherein said spaced-apart upstanding side and bottom wall portions thereof each have a configuration so as to define a passageway spaced inwardly from the ends thereof and extending generally centrally upwardly therethrough over the range of swinging movement, roof penetrating means including a central generally tubular portion secured to said lower channel-shaped formation in the region of and opening to said centrally located passageway from below and supporting said upper and lower channel-shaped formations thereon for rotation about a substantially upright axis, axially displaceable means swingably carried between said side wall portions of said upper channel-shaped formation in offset relation to said axis, actuating means extending from below said tubular shaped portion upwardly therethrough into said centrally located passageway rotatably engaging said axially displaceable means to elevate and lower same thereon so as to swing said upper channel-shaped formation from said nested disposition to said angled disposition and reversely, first control means extending generally radially outwardly from said tubular shaped portion below the roof for imparting rotation thereto, with said actuating means below said tubular shaped portion including second control means for rotating same.

2. A mounting according to claim 1 wherein clamp means are carried by said actuating means below said second control means for releasably stabilizing the disposition of said upper and lower channel-shaped formations.

3. A mounting according to claim 2 wherein said clamp means threadably engages the lowermost end of said actuating means and of an extent such that said clamp means moves upwardly into engagement with said second control means to hold same against dislodgement.

4. A mounting according to claim 1 wherein said first control means includes an elongated handle formation arranged in alignment with said channel-shaped formations for positioning same from below the roof.

5. A mounting according to claim 1 wherein said central tubular portion comprises a tubular shaft formation connected to said lower channel-shaped formation and supported for rotation within a bushing included within a roof-engaging anchor plate of said roof penetrating means.

6. A mounting according to claim 5 wherein said anchor plate presents an upstanding lug formation for engagement with a depending lug formation carried by said lower channel-shaped formation for aligning same in overlying relation thereto and to limit full rotation of said channel-shaped support formations.

7. A mounting according to claim 6 wherein said anchor plate presents an upstanding flange at the end thereof opposed to said upstanding lug formation and beyond the end of said lower channel-shaped formation when said lug formations are in aligned engagement said flange having an extent upwardly and transversely so as to register within the overlying spaced-apart side walls of said upper channel-shaped formation when swung into said nested disposition within said lower channel-shaped formation and stabilize same.

8. A mounting according to claim 7 wherein said lower channel-shaped formation is provided with a transversely extending end wall formation upstanding over said depending lug means, said end wall formation presenting upwardly opening suitably spaced-apart slots for the reception of the respective overlying spaced-apart side walls of said upper channel-shaped formation when swung into said upwardly projecting angled disposition so as to stabilize same.

9. A mounting according to claim 1 wherein said axially displaceable means includes a worm gear carried by said upper channel-shaped formation and said actuating means includes a worm extending axially of said tubular shaft formation and said worm gear.

10. A mounting according to claim 9 wherein said first control means for imparting rotation to said tubular shaft formation includes an elongated handle formation extending at substantially right angles to the axis thereof and in alignment with said channel-shaped formations, and wherein said second control means for rotating said worm includes a crank extending at substantially right angles thereto.

11. A mounting according to claim wherein said upper channel-shaped formation includes four regions of contact arranged in opposed pairs extending from the spaced-apart upstanding walls at one end thereof for securing and supporting a satellite dish centrally thereupon.

12. A mounting according to claim 11 wherein an arm formation is interconnected adjacent one end thereof to said upper channel-shaped formation in the region of said central passageway for securing a feedhorn upon the other end thereof and supported so as to swing from a disposition overlying a satellite dish to an upwardly projecting angled disposition in relation thereto and reversely.

13. A mounting according to claim 12 wherein said arm formation has a tubular configuration and is interconnected intermediately of its extent by pivot means extending between the spaced apart upstanding side walls of said upper channel-shaped formation.

14. A mounting according to claim 13 wherein compression spring means connects the inner end of said arm formation beyond said pivot means to the bottom wall of said upper channel-shaped formation, and has an extent such that said arm formation is displaced from said overlying disposition to said upwardly projecting angled disposition upon rotation of said actuating means to swing said upper channel-shaped formation from said nested disposition to said upwardly projecting angled disposition.

15. A mounting according to claim 14 wherein said tubular portion is disposed within a collar presented centrally of an anchor plate for attaching same to the roof, and wherein said axially displaceable means includes a worm gear carried by said upper channel-shaped formation, and said actuating means includes a worm extending axially within said tubular portion.

16. A mounting according to claim 15 wherein said worm gear is open ended and said worm engages said worm gear intermediately of its extent above said tubular portion, said worm presenting contact means uppermost for releasably engaging the inner end of said arm formation from below to urge same to overlie a satellite dish when said upper channel-shaped formation is swung into said nested disposition and to urge same into said upwardly projecting angled disposition when said upper channel-shaped formation is likewise swung by said worm gear and worm.

17. A mounting according to claim 13 wherein said tubular arm formation includes a releasable panel adjacent to the out end thereof for securing a selected feedhorn or the like therein.

18. A mounting according to claim 1 wherein said spaced-apart upstanding side walls of said upper channel-shaped formation are each configured to present a support formation at the end thereof, remote from said interconnection to said lower channel-shaped formation for attaching a satellite dish thereto.

19. A mounting according to claim 18 wherein said support formation presents at least four regions of contact arranged in opposed pairs upon said spaced-apart upstanding side walls of said upper channel-shaped formation.

20. A mounting according to claim 1 in which plate means is carried by said roof-penetrating means for disposition below the roof and above said means for displacement therearound and marked in azimuth for selectively positioning said channel-shaped formations and so orient said satellite dish system in relation to a broadcasting satellite.

21. In a collapsible roof mounting for supporting and orienting a satellite dish and feedhorn in relation to a signal-emitting satellite, an upper channel-shaped formation supporting the satellite dish thereupon adjacent one end and with an arm formation carrying the feedhorn located intermediately thereof and so secured thereto as to swing from an overlying disposition to said satellite dish to an angled disposition in spaced apart relation thereto, said upper channel-shaped formation nestable within and interconnected to a lower channel-shaped formation adjacent the other end thereof for swinging movement thereabove, said channel-shaped formations each having a configuration so as to define a passageway extending generally centrally upwardly therethrough throughout the range of movement, a tubular shaft formation supporting said lower channel-shaped formation from below and opening to said central passageway for rotation about a substantially upright axis, an axially displaceable tubular worm gear swingably carried by said upper channel-shaped formation and a worm extending axially of said central passageway, tubular shaft formation and said worm gear and engaging said worm gear to swing said upper channel-shaped formation from said nested disposition upwardly and reversely, a handle formation carried by said tubular shaft formation below the roof for imparting rotation thereto, and a crank located below said handle formation for imparting rotation to said worm and displacement to said worm gear.

22. In a collapsible roof mounting for supporting and orienting a satellite dish system to receive signals from a selected satellite an upper channel-shaped formation nestable within a lower channel-shaped formation, each with upstanding side walls and a bottom wall and interconnected adjacent one end thereof such that said upper channel-shaped formation swings from a generally horizontal nested disposition to an upwardly projecting angled disposition and reversely, said channel-shaped formations each having a configuration so as to define a passageway extending generally centrally upwardly therewithin, tubular roof penetrating means supporting said lower channel-shaped formation from below for rotation about a substantially upright axis and opening to said central passageway, axially displaceable means swingably carried in the region of said central passageway, including actuating means mounted for rotation within said central passageway by said upper channel-shaped formation and tubular roof penetrating means and engageable under rotation with said displaceable means so as to swing said upper channel-shaped formation from said nested disposition to said upwardly projecting angled disposition and reversely, means carried by said roof penetrating means below the roof for imparting rotation thereto and means carried by said actuating means lowermost for imparting rotation thereto.

23. A mounting according to claim 22 including means carried by said actuating means for releasably anchoring said channel-shaped formations against dislodgement.

* * * * *